United States Patent [19]

Pritchard

[11] 4,210,322

[45] Jul. 1, 1980

[54] PORTABLE TUMBLING MAT

[76] Inventor: Michael E. Pritchard, Brook Rd., Freelton, Ontario, Canada

[21] Appl. No.: 838,893

[22] Filed: Oct. 3, 1977

[51] Int. Cl.[2] ..... A63B 5/18

[52] U.S. Cl. ..... 272/109; 272/144; 46/175 R

[58] Field of Search ..... 272/1 R, 109, 56, 93, 272/144, 1 B; 5/327 B, 327 R, 70, 344, 345 B, 337; 128/25 R, 33, 78; 46/175, 178

[56] References Cited

U.S. PATENT DOCUMENTS

| | | | |
|---|---|---|---|
| 1,055,681 | 3/1913 | Steiner | 46/178 |
| 2,167,178 | 7/1939 | Kohlstadt | 5/344 X |
| 2,822,554 | 2/1958 | Wenzelberger | 5/337 |
| 2,880,428 | 4/1959 | Forsland | 5/337 |
| 2,953,793 | 9/1960 | Rossi | 5/344 X |
| 3,117,782 | 1/1964 | Johnston | 272/144 X |
| 3,173,415 | 3/1965 | Rubin | 272/109 X |
| 3,271,028 | 9/1966 | Albin | 272/144 |
| 3,498,605 | 3/1970 | Buttner | 272/144 |
| 3,689,947 | 9/1972 | Wolf | 5/344 |
| 3,784,208 | 1/1974 | Weygandt | 273/183 A |
| 3,813,716 | 6/1974 | Francis | 5/344 X |

FOREIGN PATENT DOCUMENTS

| | | | |
|---|---|---|---|
| 1496602 | 10/1967 | France | 272/144 |

*Primary Examiner*—William R. Browne

[57] ABSTRACT

The specification describes a portable exercising mat comprising a first portion and a second portion integral with one another. The second portion is constructed from a soft resilient material and is thickened relative to the first portion. The arrangement is such that when a person is lying in a supine position on the mat, with the person's head resting on the first portion, the person's back is supported by and arched over the second portion. The first portion is preferably provided with a pair of hand grips and may also be constructed from the same material as the second portion. This preferred arrangement is especially suitable for performing repeated tumbling exercises.

5 Claims, 9 Drawing Figures

PORTABLE TUMBLING MAT

FIELD OF THE INVENTION

This invention relates to a portable exercising mat.

BACKGROUND OF THE INVENTION

It is generally very difficult to teach children and especially young children to perform exercising maneuvers such as head stands, hand stands, tumbling and the like. The younger children usually have a fear of injuring themselves by falling on their backs. They can of course use conventional gymnastic mats, however, such mats are much too heavy and awkward for a young child to move and therefore, the child is restricted to the area in which he or she exercises.

Even the provision of a conventional tumbling mat may not totally rid the child of the fear of injury. Conventional mats can often be quite hard. They are flat with the back landing area is at the same level as the head supporting area, so that should the child topple backwards, the fall is not broken and the child will fall to a completely prone position absorbing the brunt of the fall in the small of the back.

In order to perform repeated tumbling exercises in the past, it has been necessary to align a plurality of tumbling mats. As can be appreciated, it is very easy to loose one's orientation and to stray from that aligned path of mats when repeating tumbling maneuvers. Due to spacial limitations, one is limited to certain areas where the aligned mats can be set up.

As anyone who exercises regularly will appreciate, continued practice in performing headstands, handstands, nip-ups, repeated tumbling maneuvers and the like can be very boring and monotonous. This is especially true for younger children who generally have a very limited span of attention.

The present invention provides a portable exercising mat comprising a first portion and a second portion integral with one another. The second portion is constructed from a soft resilient material and is thickened relative to the first portion. The arrangement is such that when a person using the mat is lying in a supine position on the mat with the user's head resting on the first portion, the user's back is supported by and arched over the second portion. Therefore, should the person exercising on the mat tumble backwards, his or her fall will be broken before reaching the prostrate or prone position. This is not only comforting from a physical stand point, but also provides a psychological inducement by helping to overcome the inherent fear of a young child in performing exercising maneuvers. The overcoming of this fear, especially in young children is the first step in acquiring basic gymnastic skills which are picked up quickly and easily through the use of the mat according to this invention.

BRIEF DESCRIPTION OF THE DRAWINGS

The above as well as other features and advantages of the present invention will become apparent in the following detailed description of the preferred embodiments according to this invention, wherein.

DETAILED DESCRIPTION OF THE PREFERRED EMBODIMENTS

Figure 1:
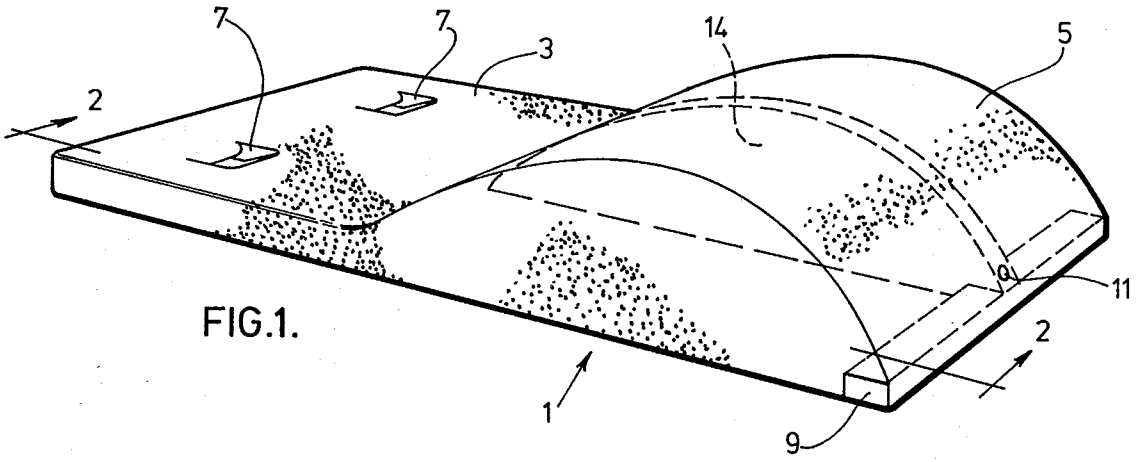
FIG. 1 is a perspective view looking down on a tumbling mat having a preferred configuration according to this invention.

FIG. 1 shows a tumbling mat generally indicated at 1, comprising first section 3 and second section 5. As becomes apparent from FIG. 2, the second section is considerably thicker than the first section. In addition, it is constructed from a soft foam rubber material or the like. The first section, which is integral with the second section, may have a similar construction.

Figure 2:
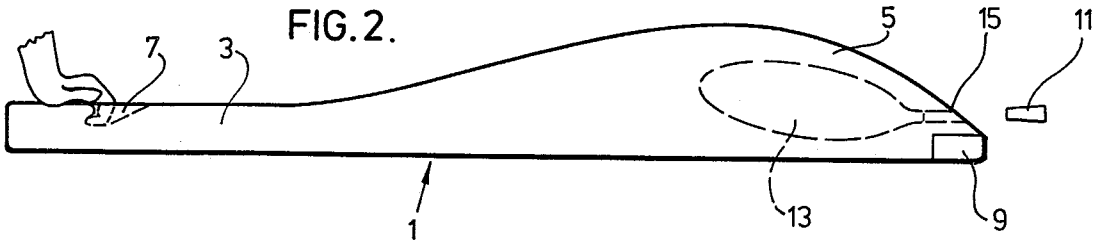
FIG. 2 is a sectional view taken along the lines 2—2 of FIG. 1 showing the user's hand in an optimal position on the tumbling mat.

The tumbling mat shown in FIGS. 1 and 2 is provided with a pair of hand grips 7. These hand grips are especially useful in performing repeated tumbling maneuvers as will be explained hereinafter. Weighted portion 9, provided in second section 5, is also of assistance in performing repeated tumbling maneuvers.

The second section can either be solid foam rubber material, or hollowed as shown in FIG. 2. The hollow area 13 may be provided with one or more supporting partitions 14 to provide additional support in the hollowed area beneath the user's back when performing various exercises.

Figure 3:
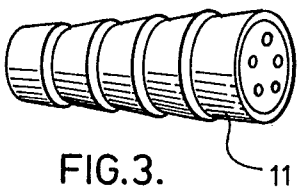
FIG. 3 is an enlarged view of the whistle shown in the extreme right hand side of FIG. 2.

Tumbling mat 1 is additionally provided with a reed or whistle 11 as shown in FIG. 3. Whistle 11 is located in a passage extending through the second section to the hollow area so that upon partial collapse of the second section, air is expelled from hollow area 13 through whistle 11 provided in passage 15 to produce a noise from the whistle. The whistle is constructed to permit the return of air to hollowed area 13. It will be appreciated that whistle 11 can be replaced by any type of noise-making device.

Figure 4:
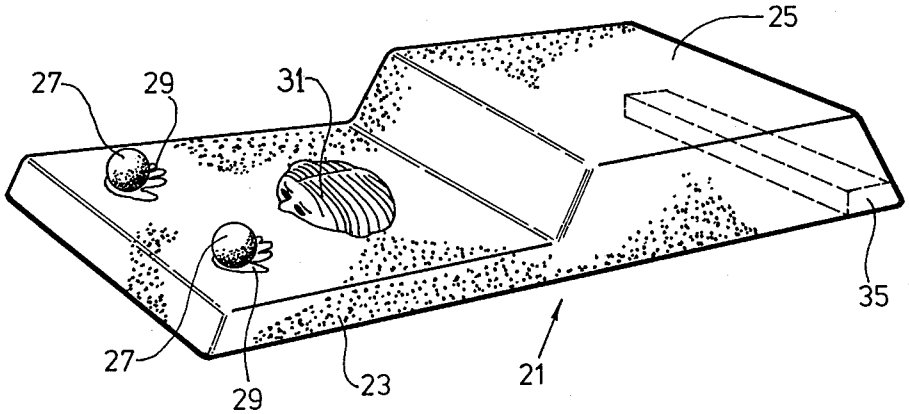
FIG. 4 is a perspective view looking down on an alternative preferred construction for the tumbling mat according to this invention.

FIG. 4 shows a tumbling mat 21, having a somewhat different configuration. This mat includes first section 23 and second section 25. The first section is provided with a pair of ball hand grips 27, hand grip markings 29 and head position marking 31. Second section 25 is provided with weighted portion 35.

Figure 8:
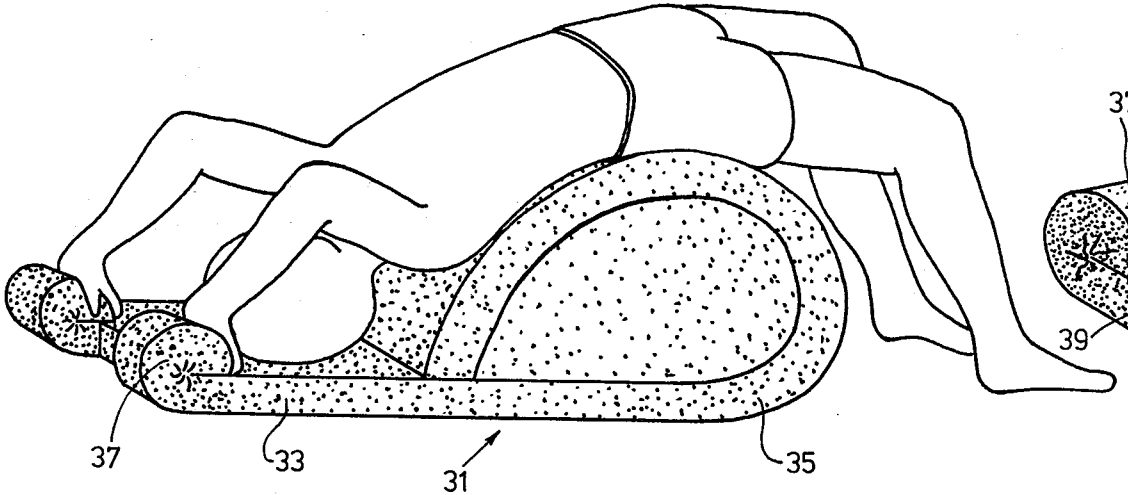
FIG. 8 is a perspective view looking down on still another preferred construction of a tumbling mat according to this invention, showing the user in a supine position with his head resting on the first section and his back arched over the second section.

FIG. 8 shows a tumbling mat 31 constructed from a single piece of foam rubber rolled back upon itself to provide a first section 33 and a second section 35. Again, second section 35 may be provided with supporting partitions. It will be noted from FIG. 8 that the second section of mat 31 is considerably thicker than first section 33.

Figure 9:
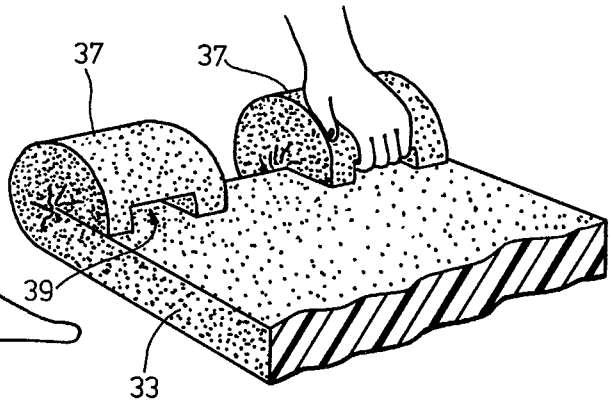
FIG. 9 is an enlarged perspective view of the hand grips of the tumbling mat shown in FIG. 8.

Hand grips 37 including cut away portions 39 for clamping engagement with the user's hands during repeated tumbling exercises, are best shown in FIG. 9.

Tumbling mat 1, shown in FIG. 1 is especially suited for production by injection molding. All three of the mats shown in FIGS. 1, 4 and 8 are preferably provided with a tough outer skin which does not detract from the cushioning of the mat, but does add to the mat's durability.

All of the mats shown in the drawings are used in essentially the same manner. The user positions his or her head over the first section of the mat. If the user is performing head stands or hand stands, the hands may be placed on the floor at the sides of the first section, or directly on the first section so that the hand grips need not necessarily be provided on the mat. When the user locates his or her head over the first section, the user's back immediately assumes the position where it will be cushioned by the second section, should the user topple backwards to a supine position. As can be seen in FIG. 4, first section 23 of mat 21 is flat to assist in performing head stands. If the first section were inclined from the horizontal, it would tend to tilt the head at an angle, and topple the person performing the head stand.

The tumbling mat shown in FIGS. 4 through 7 is adapted for use by very young children. Hand grip markings 29 indicate that the palm of the hand should be placed over the ball grips 27 for holding on to the ball grips during repeated tumbling maneuvers. In addition, head marking 31 indicates to the child the optimal position for the top of the head.

Figure 7:
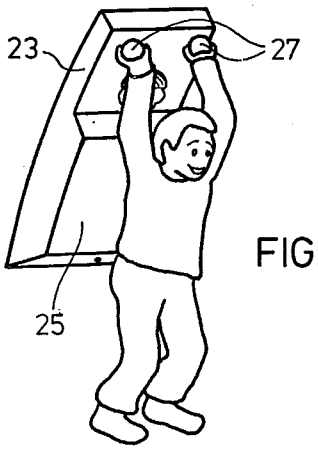
FIGS. 5 through 7 are perspective views looking down on a child using the tumbling mat of FIG. 4 in performing repeated tumbling exercises.
Figure 6:
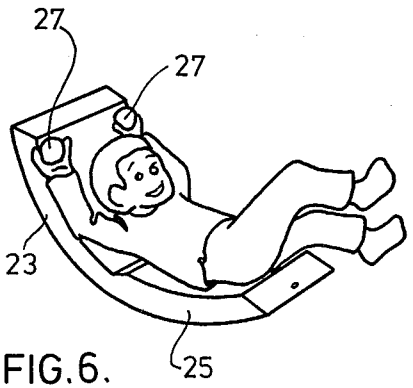
Figure 5:
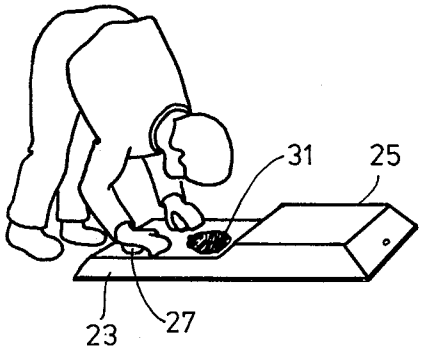

FIGS. 5 through 7 show the use of the mat for repeated tumbling maneuvers. The user assumes the proper positioning by grasping the hand grips and locating his or her head over the first section of the mat. Thereafter he or she simply rolls forward to a supine position where the second section of the mat cushions the fall of the back before the user assumes a completely prone or prostrate position. The user maintains a grasp on the hand grips so that the mat moves with the user for further tumbles. As becomes apparent from FIG. 8, the back is arched over the second section with the user's legs curled around until his or her feet contact the ground. This arching of the back and curling of the legs significantly enhances the user's ability to return to the standing position for performing further tumbles.

The light construction of the mat, makes it easy to flip up and over the head of the user. The weighted portion at the end of the second section is also made from a soft material which is heavier than the rest of the mat. This additional weight at the free end of the mat provides a hinging effect at the juncture between the first and second sections which also assists in flipping the mat.

When a child uses a mat such as that shown in FIG. 4, he or she will be rewarded by the noise made from the noisemaking device each time a proper tumble is performed. This, as is the case with any other noisemaking device, maintains the intrigue of the child so that he or she will continue to practice and quickly acquire basic gymnastic skills.

The elevation of the second section relative to the first section, fulfills two functions. Physically it cushions and arches the user's back prior to reaching a prostrate position. Mentally it provides the impetus required to persuade a child to perform exercises in which the child can possibly fall onto his or her back. Furthermore, in performing repeated tumbling exercises, the user is not restricted to a predetermined path, nor does the user miss the mat by losing his or her orientation because the mat moves with the user.

Although various preferred embodiments of the invention have been described herein in detail, it will be apparent to one skilled in the art that variations may be made thereto without departing from the spirit of the invention or the scope of the appended claims.

The embodiments of the invention in which an exclusive property or privilege is claimed are defined as follows:

1. A portable tumbling mat comprising a first portion and a second portion integral with one another, said portions being constructed from a soft resilient material, said first portion being provided on its upper surface with a pair of hand grips, said second portion constituting a major share of said mat and being thickened relative to said first portion, said second portion including a hollow area and a passage extending through said second portion to said hollow area, said passage being provided with a noise making device so that with each tumble on said mat, said hollow area is deflated, thereby expelling air through said passage to produce a noise from said noise making device, said hollow area being reinflateable between each tumble.

2. A tumbling mat as defined in claim 1 wherein said hollow area is provided with at least one supporting partition to provide additional support in said second portion.

3. A tumbling mat as claimed in claim 1, wherein said noise making device is a reed or whistle.

4. A portable tumbling mat comprising a first portion and a second portion, integral with one another; said portions being constructed from a soft resilient material, said first portion being provided on its upper surface with a pair of hand grips comprising cut-away indentations for clamping engagement with the user's hands for performing repeated tumbling exercises, said second portion constituting a major share of said mat being thickened and relative to said first portion; the arrangement being such that when a person is lying in a supine position on said mat with the user's hands engaging said hand grips and with the user's hands engaging said hand grips, and with the user's head resting on said first portion, the user's back is supported by and arched over said second portion, thereby enhancing the user's ability to perform repeated tumbling exercises.

5. A portable tumbling mat comprising a first portion and a second portion integral with one another; said portions being constructed from a soft resilient material, said first portion being provided on its upper surface with a pair of hand grips, having hand grip markings for indicating the optimal hand positions for performing repeated tumbling maneuvers; said second portion constituting a major share of said mat and being thickened relative to said first portion; the arrangement being such that when a person is lying in a supine position on said mat with the user's hands engaging said hand grips and with the user's head resting on said first portion, the user's back is supported by and arched over said second portion thereby enhancing the user's ability to perform repeated tumbling exercises.

* * * * *